US008517757B1

(12) United States Patent
Unger et al.

(10) Patent No.: US 8,517,757 B1
(45) Date of Patent: Aug. 27, 2013

(54) OPERATING FUSE DEFLECTOR AND METHOD OF USE

(75) Inventors: Thomas A. Unger, Erie, PA (US); Charles E. Murrill, Jr., Wilmer, AL (US)

(73) Assignee: Thomas A. Unger, Erie, PA (US)

( * ) Notice: Subject to any disclaimer, the term of this patent is extended or adjusted under 35 U.S.C. 154(b) by 0 days.

(21) Appl. No.: 13/245,935

(22) Filed: Sep. 27, 2011

Related U.S. Application Data

(60) Provisional application No. 61/387,063, filed on Sep. 28, 2010.

(51) Int. Cl.
*H01R 13/00* (2006.01)

(52) U.S. Cl.
USPC ..... 439/480; 81/53.1

(58) Field of Classification Search
USPC . 439/476.1–481; 81/53.1, 3.8; 337/168–175
See application file for complete search history.

(56) References Cited

U.S. PATENT DOCUMENTS

| | | | |
|---|---|---|---|
| 1,853,598 | A | 4/1932 | Birkenmaier |
| 1,858,133 | A | 5/1932 | Bodendieck |
| 1,994,938 | A | 3/1935 | Bott |
| 2,382,147 | A | 4/1945 | Hanak |
| 2,816,985 | A | 12/1957 | Lindell |
| 3,026,391 | A | 3/1962 | Bridges et al. |
| 3,611,240 | A | 10/1971 | Mikulecky |
| 3,868,136 | A | 2/1975 | Schweitzer, Jr. |
| 4,230,357 | A | 10/1980 | Bosch et al. |
| 4,397,491 | A | 8/1983 | Anderson |
| 4,543,021 | A | 9/1985 | Adler |
| 5,077,448 | A | 12/1991 | Andrew |
| 5,532,668 | A | 7/1996 | Fennell |
| 5,593,196 | A | 1/1997 | Baum et al. |
| 5,666,253 | A | 9/1997 | Whited et al. |
| 5,670,927 | A | 9/1997 | Fennell |
| 5,861,595 | A | 1/1999 | Wood et al. |
| 5,886,613 | A | 3/1999 | Magoon et al. |
| 5,917,142 | A | 6/1999 | Chang |
| 6,386,893 | B2 | 5/2002 | Reum et al. |
| 6,474,197 | B1 | 11/2002 | Browen et al. |
| 6,583,708 | B1 | 6/2003 | Smith et al. |
| 6,725,745 | B1 | 4/2004 | Palmieri |
| 7,181,995 | B2 | 2/2007 | Rider |
| 7,185,561 | B1 | 3/2007 | Eastman |
| 7,428,131 | B2 | 9/2008 | Stillwagon et al. |
| 7,775,570 | B2 | 8/2010 | Taylor |
| 7,786,841 | B2 | 8/2010 | Kesting |

*Primary Examiner* — Khiem Nguyen
(74) *Attorney, Agent, or Firm* — Robert M. Bauer

(57) ABSTRACT

Shields or deflectors are supported on fuse barrels and positioned to protect power linemen and other electrical workers on high voltage distribution lines against injuries resulting from the ejection of sparks and fuse debris that occurs when a fuse melts or operates due to excessively high electrical currents, by securing the deflectors on the fuse barrels in a position immediately below the fuse barrels where the deflectors can effectively direct the dangerous materials away from the workers.

11 Claims, 5 Drawing Sheets

OPERATING FUSE DEFLECTOR AND METHOD OF USE

CROSS REFERENCE TO RELATED APPLICATIONS

This application claims the benefit of U.S. Provisional Application Ser. No. 61/387,063 filed Sep. 28, 2010.

STATEMENT REGARDING FEDERALLY SPONSORED RESEARCH OR DEVELOPMENT

Not Applicable.

BACKGROUND OF THE INVENTION

A fuse cutout as used in electrical distribution is primarily used to protect distribution transformers from current surges and overloads. An overcurrent, caused by a fault in a transformer, for example, will cause the fuse to melt, or operate, thus disconnecting the transformer from the line. It can also be opened manually.

A cutout consists of three major components. The cutout body provides a frame that supports the fuse holder and an insulator that electrically isolates the conductive portions of the support to which the insulator is fastened; the fuse holder or barrel, which contains the interchangeable fuse element or fuse; and, the fuse element, which is the replaceable portion of the assembly that melts or operates due to excessively high electrical currents. Fuses are provided to operate at suitable ampere ratings ranging from 1 to 200 amperes.

A fuse cutout is usually mounted about 20 degrees off vertical so that the center of gravity of the fuse holder is displaced when the fuse element operates, and the fuse holder will rotate by its own weight away from the cutout body when the fuse blows. Each fuse holder will have an attached pull ring or other structure that can be engaged by a hook to manually open the switch.

Overhead high voltage electrical distribution lines in the United States use fuses to protect the integrity of the delivery system from electrical current surges and overloads. These fuses typically are in 100 amp or 200 amp models. When the fuse is triggered, the bottom portion of the fuse barrel explodes and the fuse link is destroyed. This explosion causes a large spark as well as other fuse debris to be discharged downwardly from the bottom portion of the fuse barrel. Once the fuse is blown, the fuse barrel hangs in a downward fashion from the overhead line and visual inspection can verify the blown fuse.

A common safety problem occurs with fuses when the fuse is triggered while an electrical worker (typically referred to as a "linesman") is in close proximity to the fuse. The linesman can be seriously injured by the sparks and debris that shoot out of the bottom of the fuse barrel. The present invention is directed to providing a fuse deflector or shield that will deflect away from the lineman, the sparks and debris typically released from the bottom of the fuse barrel when there is an electrical surge and/or overload to high voltage overhead electrical lines.

BRIEF SUMMARY OF THE INVENTION

It is an object of the present invention to provide a deflector or shield to direct the sparks and debris that are ejected from the bottom of a fuse barrel upon the event of an electrical surge or overload that activates the fuse.

It is a further object of the present invention to provide a safety device to protect linemen from the sparks and debris that are ejected when a fuse operates while the linemen are performing their work on high voltage overhead electrical lines.

It is a further object of the present invention to direct the sparks and debris that are ejected upon actuation of the fuse in a direction away from the lineman working nearby.

It is a still further object of the present invention to provide a clip member to facilitate the use of a hot stick to remove blown fuse tubs and to install new fuse tubes.

It is another object of the present invention to provide a fuse deflector that is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

BRIEF DESCRIPTION OF THE SEVERAL VIEWS OF THE DRAWING(S)

These and other features, aspects and advantages of the present invention will become better understood with regard to the following description, appended claims, and accompanying drawings where:

DETAILED DESCRIPTION OF THE INVENTION

Figure 1:
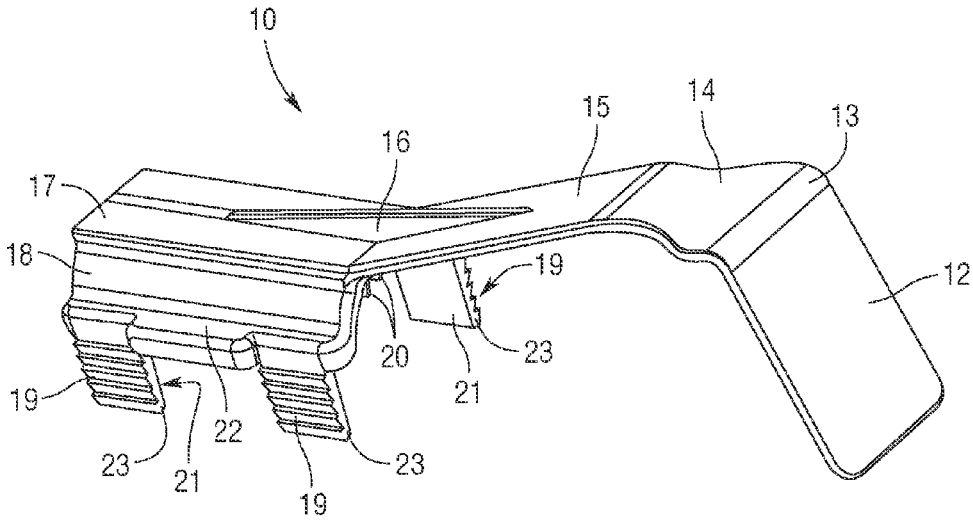
FIG. 1 is an isometric view of a first side of the deflecting member showing the deflector and the first side of the attaching structure of the two-piece deflector.

To protect electrical line workers, the present invention is directed to a one or two piece fuse deflector having a deflecting member and a clip member. FIG. 1 provides an isometric view of a first side of the deflecting member 10. Said deflecting member 10 is comprised of a deflecting plate 12 attached by an angle mount 13 adjacent to a connector 14 and a long member 15 attached by a cross member 16 which serves to reinforce the attachment between the long member 15 and the housing 17. Said deflecting portion 12 is angled at an effective position to deflect sparks and debris via said angle mount 13. The housing 17 is formed with two angled portions 18 on either side of said housing 17 which are then attached on each side to two clip constituents 23. Said clip constituents 23 have a front ridged side 19 and a smooth side 21. A member 22 is connected to the angled portion 18 between the two clip constituents 23. The underside of the housing contains grips 20, which keeps the deflecting member 10 from slipping when engaged with a clip member on a fuse barrel as contemplated by the within invention.

Figure 2:
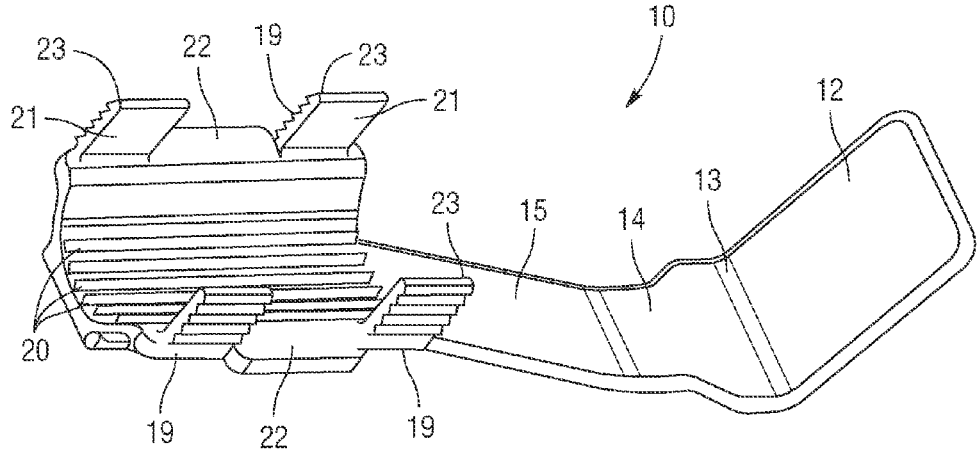
FIG. 2 is an isometric view of a second side of the deflecting member showing the second side of the attaching structure of the two-piece deflector.

FIG. 2 is an isometric view of a second side of the deflecting member 10 which provides a better view of the grips 20 as well as the formation of the clip constituents 23 with their ridged side 19 and smooth side 21 on either side of the member 22.

Figure 3:
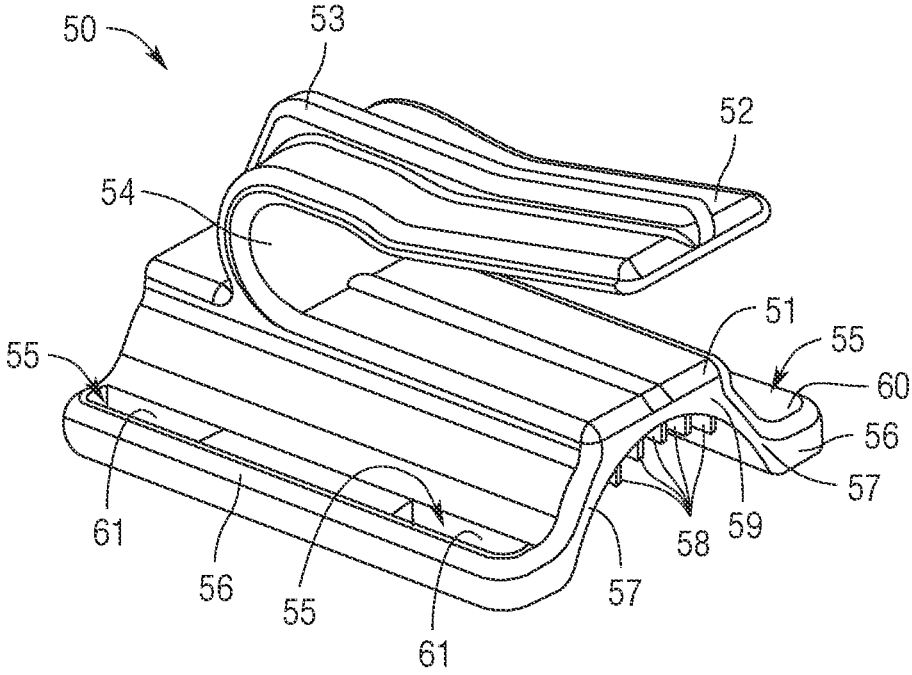
FIG. 3 is an isometric view of a first side of the clip member of the two-piece deflector showing the positioning hook and the first side of the attaching structure.

FIG. 3 is an isometric view of a first side of the clip member 50. Said clip member 50 is comprised of an attaching member 51 attached to a housing member 59. One side of said attaching member 51 is attached to an angled member 54 which is further attached to a top member 52. Said top member 52 and angled member 54 are further supported and attached with a reinforcement member 53. The housing member 59 is attached on both sides to curved areas 57 which are then attached to the joining members 56 on each side. Said joining members 56 contain cavities 55 which run the length of said joining members 56. The cavities 55 contain ridged walls 60 on the outermost walls and smooth walls 61 on the innermost walls. The housing member 59 is attached to the grips 58 on its underside. Said grips 58 keep the clip member 50 from slipping when engaged with a deflecting member on a fuse barrel.

Figure 4:
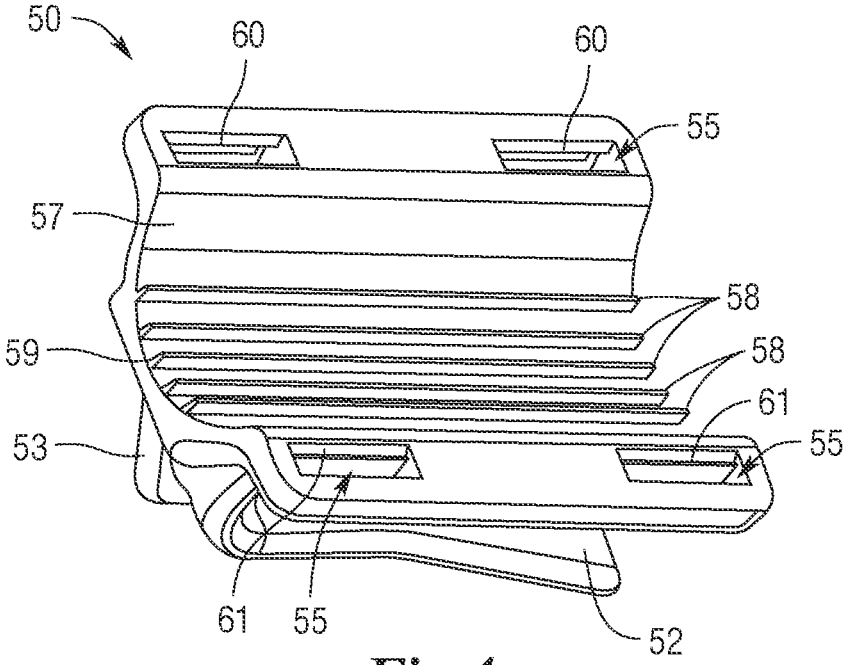
FIG. 4 is an isometric view of a second side of the clip member of the two-piece deflector showing the second side of the attaching structure.

FIG. 4 is an isometric view of a second side of the clip member 50 which provides a clearer view of the grips 58 as well as the ridged walls 60 and smooth walls 61 contained in the cavities 55.

Figure 5:
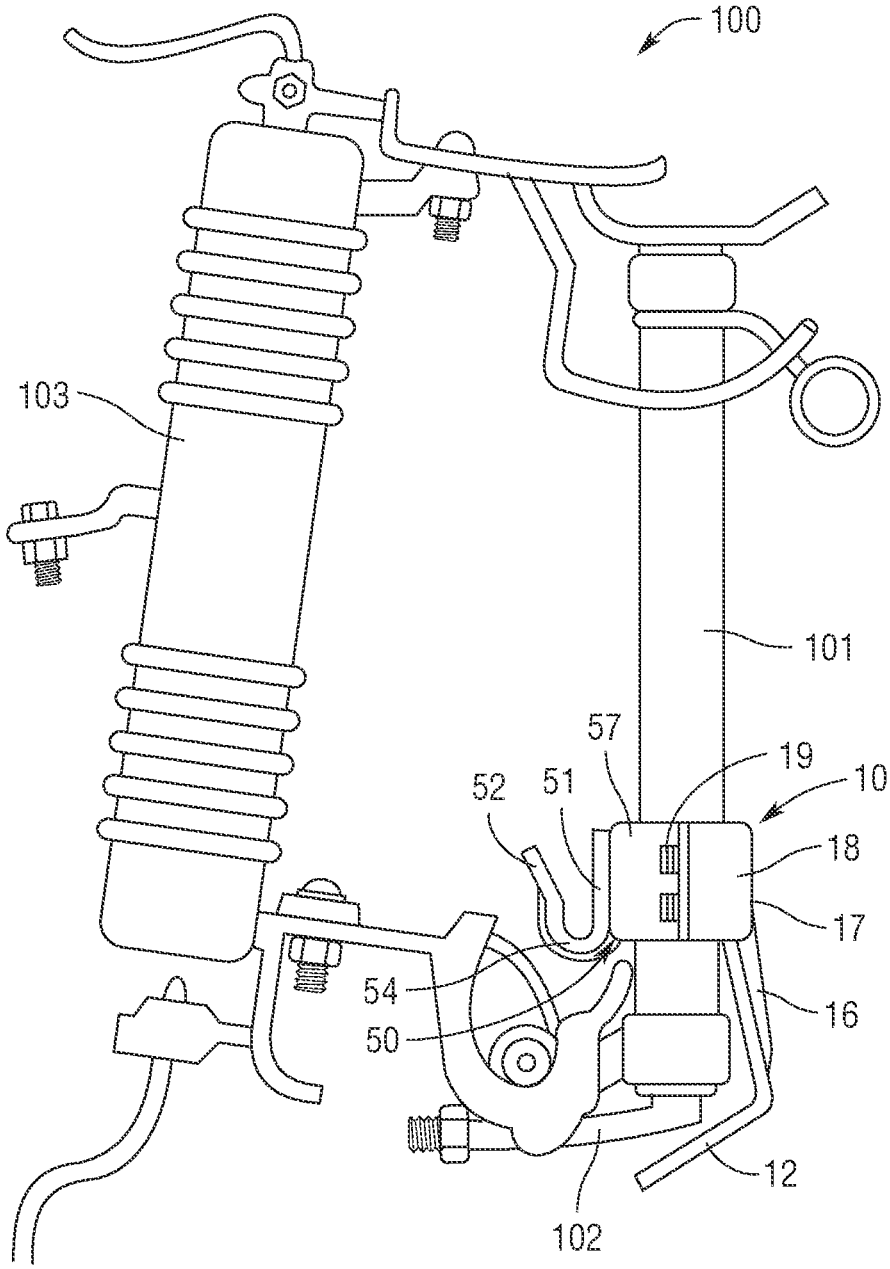
FIG. 5 is a perspective view of the two-piece deflector engaged with a fuse barrel on a typical fuse.

FIG. 5 shows the present invention engaged with a fuse barrel on a typical fuse 100. The fuse switch body 103 is connected to the fuse barrel 101. The deflector plate 12 is placed just below the fuse link 102. The housing 17 and angled portion 18 of the deflecting member 10 are engaged with the curved areas 57 of the clip member 50 with the ridged sides 19 of the clip constituents 23 viewable as they protrude the cavities 55. The entire deflector is engaged with the circumference of the fuse barrel 101 and can be moved up and down said fuse barrel 101 to allow the proper distance between the deflector plate 12 and the fuse link 102.

Figure 6:
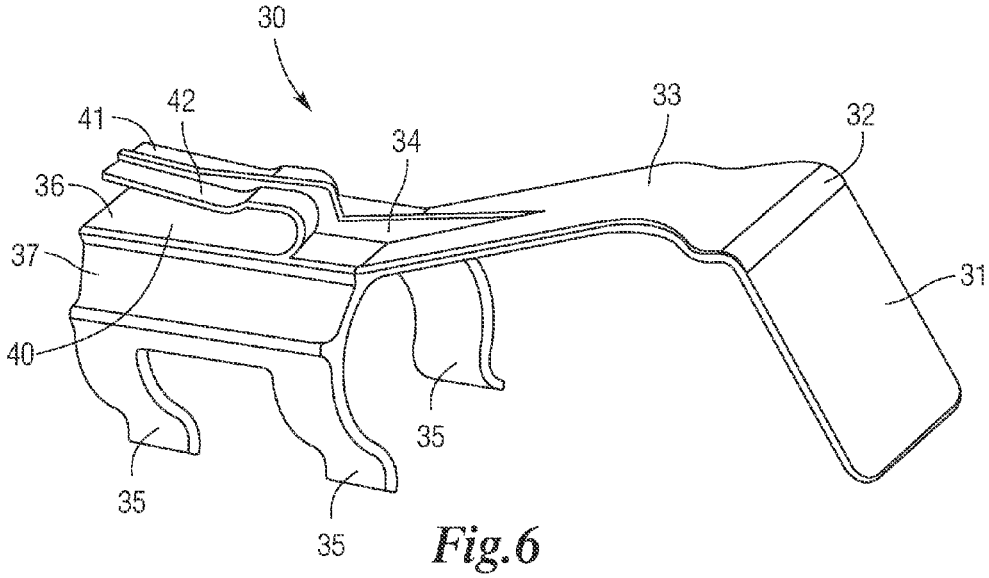
FIG. 6 is an isometric view of a first side of the deflecting member of a one-piece deflector showing the integral positioning member.

FIG. 6 provides an isometric view of a first side of the deflecting member 30 of a one-piece deflector showing the integral positioning member, according to the invention. Said one piece deflecting member 30 is comprised of a deflecting plate 31 at a first distal end of the deflecting member 30. The deflecting plate 31 is integrally attached to an angle mount 32, which positions the deflecting plate in an effective position to protect a lineman in the event of a fuse operating. The angle mount 32 is also integrally attached to the long member 33, which member is reinforced along its length by a cross member 34. Flexible attaching members 35 are attached to housing 36 and angled portions 37, and extend outwardly therefrom to engage a fuse barrel 101 loaded with a fuse 100. A fuse barrel 101 loaded with a fuse 100 may have a deflecting member 30 snapped into a secure operative position by means of the flexible attaching members 35. With deflector shield 31 positioned below said fuse barrel 101, and may be placed in service as contemplated by the invention.

Figure 7:
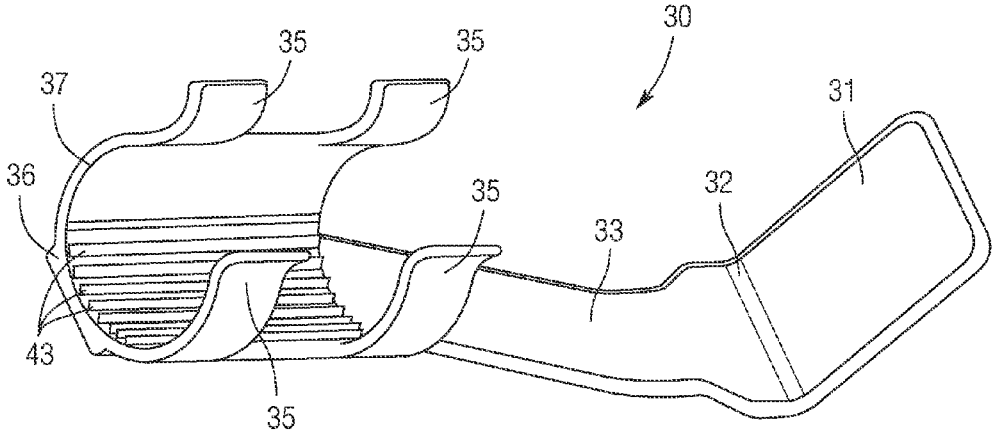
FIG. 7 is an isometric view of a second side of a one-piece deflector showing the fuse barrel attaching structure and the deflector.

FIG. 7 is an isometric view of a second side of a one-piece deflector member 30 showing the fuse barrel attaching structure 35 the grips 43, and the deflector 31. FIG. 7 shows the reverse of deflector plate 31, angle mount 32, the long member 33 and the smap in fit of flexible attaching members 35 and the deflector.

Figure 8:
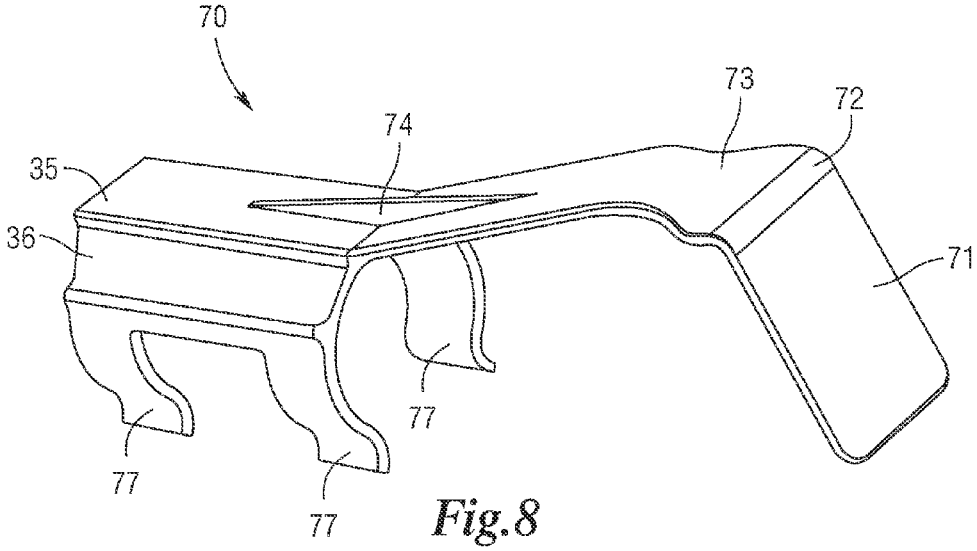
FIG. 8 is an isometric view of the bottom side of a one-piece deflector without a positioning member.

FIG. 8 is an isometric view of a first side of a one-piece deflector 70 without a positioning member. The one piece deflector comprises deflecting plate 71 integrally attached to a long member 73, which is integrally attached to housing 76 and angled portions 77, from which flexible attaching members 78 extend outwardly to grip fuse barrel 101 containing the fuse 100.

Figure 9:
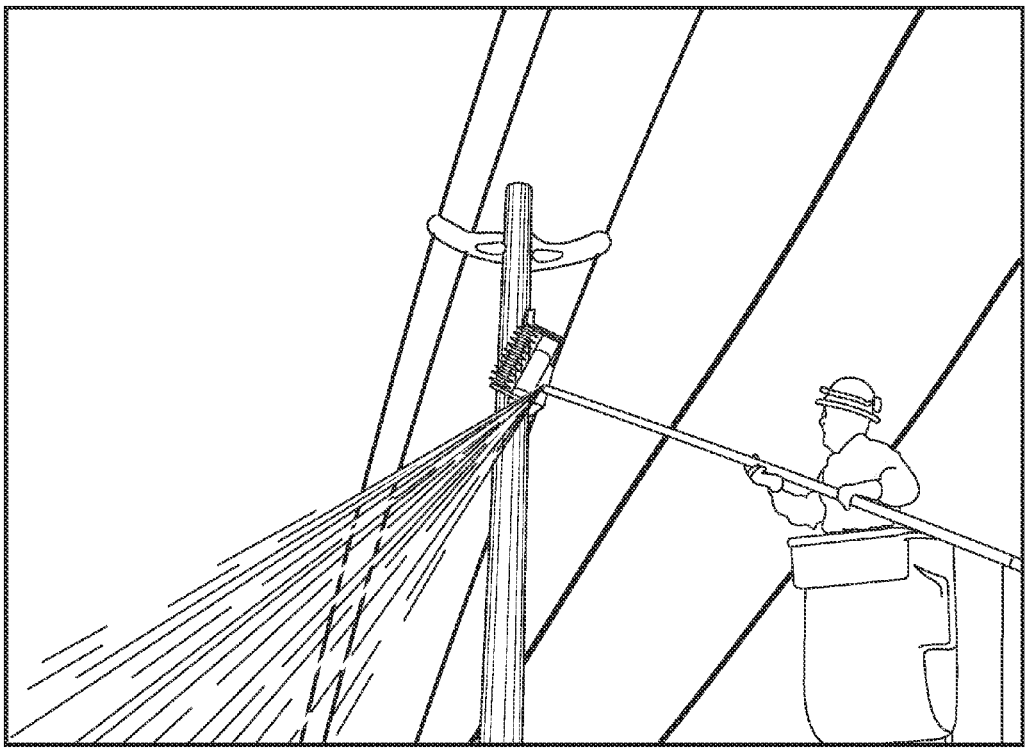
FIG. 9 is a perspective view of a fuse which has operated according to the invention illustrating the deflector directing the sparks and debris away from a lineman.

FIG. 9 is a perspective view of a fuse 100 inside the fuse barrel 101. As shown, the fuse has operated according to the invention and is illustrating the deflector directing the sparks and debris away from a lineman.

Operation

The present invention is a one or two-piece implement formed from hard plastic with flame retardant properties, including, but not limited to sycolac resin MG 47-F and ABS (acrylonitrile butadine styrene).

To utilize the present invention, a linesman attaches the deflecting member 10 such that the area with the grips 20 is engaged with the fuse barrel 101 of the fuse 100. The clip member 50 is then raised to engage via the grips 58 with the area opposite the circumference of the fuse where the deflecting member 10 is being held. The clip member 50 is then connected to the deflecting member 10 such that the clip constituents 23 are joined through the cavities 55 and such that the ridged walls 60 are secured with the ridged sides 19 to join both the deflecting member 10 and the clip member 50 around the circumference of the fuse barrel 101. The deflecting plate 12 is to be adjusted such that it is positioned under the bottom of the fuse barrel 101.

To utilize the one piece structure of the present invention, a lineman attaches the deflecting member 30 by snapping the fuse barrel into engagement with the flexible attaching members 35, along the length of the fuse barrel 101 with the deflecting plate positioned just below and extending under the lower end of the fuse barrel 101 to redirect the sparks and fuse debris in the event that the fuse operates.

As shown in FIG. 5, with the deflector plate 12 in place, should a burst of electricity run through the fuse 100, the sparks that usually discharge from the bottom of the fuse barrel 101 at the fuse link 102 are deflected by the deflector plate 12 so that there is no shower of sparks and/or debris which could potentially injure a worker near the fuse 100. The instant invention is designed such that after a triggering event, the fuse barrel 101 can still disengage from the rest of the fuse housing and hang in a downward fashion to allow visual inspection of the blown fuse.

Another feature of the disclosed invention includes the engagement of the deflecting member 10 and the clip member 50 to allow for different sized fuse barrels, which typically are between 1 inch and 1 and 3/16 inches.

In another feature of the invention, the clip member 50 is formed such that a lineman can lift said member into place using what is known in the industry as a "hot stick." A hot stick is a long insulated pole with a metal end. The lineman engages the hot stick with the clip member 50 such that the hot stick fits in between the space formed by attaching member 51, the angled member 54 and the top member 52. The hot stick is then raised from the ground (or the utility pole) and engaged around the fuse barrel circumference with the deflecting member 10 to provide the fuse blow out prevention as described above.

From the descriptions above, a number of advantages of the fuse deflector become evident:

1. An easy, efficient and cost-effective way to protect workers in close proximity to overhead fuses associated with high voltage electrical lines;

2. An easily placed safety system which does not interrupt the flow of electricity of high voltage electrical lines;

3. A removable safety device to protect workers in close proximity to overhead fuses; and, 4. Adjustable devices which can fit on a number of different circumferences fuse barrels to protect workers in close proximity to overhead fuses.

The foregoing specification sets forth the invention in its preferred, practical forms but the structure shown is capable of modification within a range of equivalents without departing from the invention which is to be understood is broadly novel as is commensurate with the appended claims.

We claim:

1. A deflector attachment for use with a fuse cutout, the deflector attachment having first and second ends and comprising: an attaching structure at the first end to secure the deflector attachment to a deflector fuse barrel, and a deflector plate at the second end supported adjacent the lower end of the fuse barrel in a position to direct sparks and ejected debris away from a lineman, wherein said attaching structure comprises housing and angled positions to form a rounded concave surface with grips to engage the fuse barrel, and four spaced clip constituents with ridged outwardly facing surfaces and smooth inwardly facing surfaces.

2. The deflector plate according to claim 1 wherein said deflector plate is integrally connected to said deflector attachment.

3. The deflector attachment according to claim 1 wherein said deflector attachment, attaching structure and deflector plate are of molded sycolac resin.

4. The deflector plate according to claim 1 wherein said deflector plate comprises a generally flat plate positioned at an angle to the deflector attachment of more than 90 degrees.

5. The attaching surface according to claim 1 further comprising a clip member, said clip member being attachable to said attaching structure, and comprises a rounded concave surface with grips adapted to engage a fuse barrel, and four spaced holes to receive the outwardly extending clip constituents from the attaching structure and secures the deflector attachment to the fuse barrel.

6. The deflector attachment according to claim 1 may further comprise an attaching member which provides a hook for a lineman to use to manipulate the fuse barrel into the fuse cutout.

7. A method of using a fuse deflector with a fuse, comprising:

attaching the fuse deflector, said fuse deflector having a rounded concave surface with grips and four spaced clip constituents with ridged outer surfaces and smooth inner surfaces, such that the grips of the fuse deflector are engaged with a fuse barrel of the fuse;

raising a clip member, said clip member having a rounded concave surface with grips adapted to engage said fuse barrel and four spaced holes with ridged walls to receive the outwardly extending clip constituents from the fuse deflector, to engage with the area opposite the circumference of the fuse where the fuse deflector is being held;

connecting the clip member to the fuse deflector such that the clip constituents are joined through the holes and the ridged walls of the clip member are secured with the ridged outer surfaces of the clip constituents, to join both the fuse deflector and the clip member around the circumference of the fuse barrel; and adjusting a deflecting plate of the fuse deflector such that it is positioned under the bottom of the fuse barrel.

8. The method of claim 7, wherein said deflecting plate is integrally connected to said fuse deflector.

9. The method of claim 7, wherein said fuse deflector and deflecting plate are of molded sycolac resin.

10. The method of claim 7, wherein the deflecting plate comprises a generally flat plate positioned at an angle to the fuse deflector of more than 90 degrees.

11. The method of claim 7, wherein the steps of raising and connecting uses a hook provided on the clip member.

* * * * *